United States Patent [19]

Nakamura et al.

[11] Patent Number: 5,049,865

[45] Date of Patent: Sep. 17, 1991

[54] DISPLAY APPARATUS

[75] Inventors: Tadashi Nakamura; Toshiro Wakabayashi, both of Tokyo, Japan

[73] Assignee: NEC Corporation, Japan

[21] Appl. No.: 265,245

[22] Filed: Oct. 31, 1988

[30] Foreign Application Priority Data

Oct. 29, 1987 [JP] Japan ..... 62-275151
Oct. 29, 1987 [JP] Japan ..... 62-275152

[51] Int. Cl.[5] ..... G09G 3/04; G09G 3/36

[52] U.S. Cl. ..... 340/758; 340/784; 340/811; 359/55

[58] Field of Search ..... 340/752, 758, 784, 805, 340/802, 811, 768; 350/333, 332; 358/241

[56] References Cited

U.S. PATENT DOCUMENTS 4,499,459 2/1985 Sasaki et al. ..... 340/784
4,630,122 12/1986 Morokawa ..... 340/784
4,739,320 4/1988 Dolinar et al. ..... 340/805

*Primary Examiner*—Jeffery A. Brier

*Assistant Examiner*—M. Fatahiyar

*Attorney, Agent, or Firm*—Ostrolenk, Faber, Gerb & Soffen

[57] ABSTRACT

A display apparatus having an X-Y matrix type display panel with data and scanning electrodes has a driving circuit for driving the scanning electrodes which driving circuit is divided into two portions. One portion is for odd-numbered scanning electrodes and another portion is for even-numbered scanning electrodes. By actuating the odd-numbered electrode driving circuit and the even-numbered electrode driving circuit alternately, in a staggered fashion, a conventional single electrode scanning mode is obtained. However, when the odd-numbered electrode driving circuit and the even-numbered electrode driving circuit are simultaneously actuated, a dual electrode scanning mode is obtained. Thus, two diffrent scanning modes can be obtained by providing an appropriate display mode switching signal to the odd-numbered and even-numbered electrode driving circuits.

9 Claims, 8 Drawing Sheets

DATA SIGNAL 8
CLOCK SIGNAL 9
CLEAR SIGNAL 6
VY 1
VY 2
VY 3
VY 4
VY 1'
VY 2'
VY 3'
VY 4'

SHIFT REGISTER
X-ELECTRODE DRIVE CIRCUIT
DISPLAY PANEL
DRIVING CONTROL CIRCUIT
SHIFT REGISTER
4
40
41
412
414
41m
2
Y2
Y4
Ym
5
Y1
Y3
Ym-1
311
312
31m-1
3
30
1
6
8
9
10
11
61
14
15
16
17
12
13

D Q Q̄ C R
Vcc
211
221
12
13
14
15
201
19
18
16
0 1 2 3 4 5 6 7 8
R
C

SHIFT DRIVER
EVEN-NUMBER Y-DRIVER
SHIFT REGISTER
LATCH
X-DRIVER
ODD-NUMBER Y-DRIVER
SHIFT REGISTER
DRIVING CONTROL CIRCUIT
X-CLOCK SIGNAL
X-DATA SIGNAL
8
9
4
40
42
20
21
22
5
2
32
3
30
11
61
10
15
1
16
17
14
12
13

V. SYNC 12
H. SYNC 13
CLOCK(x)
DATA(x)
DATA 8
CLOCK 9
CLEAR 6
VY1
VY2
VY3
VY4
VX1
VX2
VX3
VX4

V.SYNC 12
H. SYNC 13
CLOCK(X)
DATA(X)
DATA 8
DATA 9
CLEAR 6
VY1
VY2
VY3
VY4
VX1
VX2
VX3
VX4

DISPLAY APPARATUS

BACKGROUND OF THE INVENTION

This invention relates to X-Y matrix type display panels, and more particularly to a driving circuit for scanning and driving electrodes thereof dynamically.

Wide use has been made for flat display panels of plasma display panels, liquid crystal display panels, or electroluminescent display panels for use as X-Y matrix display panels. An X-electrode group ($X_1$, $X_2$, . . . $X_n$) containing n elements is referred to herein as the data electrode group, and a Y-electrode group ($Y_1$, $Y_2$, . . . $Y_m$) of size m as the scanning electrode group. According to the prior art method of driving X-Y maxtrix display panels, the scanning electrodes are sequentially selected one by one in a time-division multiplexing mode. A desired display is obtained by selecting X-electrodes in correspondence to the selected single Y-electrode.

In such a single electrode scanning mode, an exclusive dedicated interface signal is required for each panel configuration having corresponding number of scanning electrodes. For instance, in a display apparatus wherein the number of X-electrodes is 640 and that of Y-electrodes is 400 having 640×400 display cells, only a display of 640×400 dot mode is possible. Similarly, the display apparatus having 640×200 display cells (n=640, m=200) can only display in the 640×200 dot mode. The prior art apparatus is, therefore, limited in that the display apparatus of 640×400 dots cannot be driven with the interface signals for a display of 640×200 dots.

SUMMARY OF THE INVENTION

Accordingly, an object of this invention is to provide a display apparatus operable in plural display modes.

According to this invention, a display apparatus comprises a display panel, first and second driving circuits and first, second and third control means. The display panel has a first group of electrodes and a second group of electrodes disposed to select respective display cells. The first driving circuit is connected to the first group of electrodes for selectively applying driving signals to predetermined electrodes thereof. The second driving circuit is connected to the second group of electrodes for selectively applying driving signals to predetermined electrodes of the second group of electrodes in correspondence with the signal applying timing of the first driving circuit. The first control means for controlling the first driving circuit is provided such that each of the first group of electrodes is sequentially selected one by one in a time-divisional mode. The second control means for controlling the first driving circuit is provided such that a plurality of adjacent electrode of the first group of electrodes are sequentially selected at the same time in a time-divisional mode. And the third control means is used for actuating either one of said first control means and second control means.

BRIEF DESCRIPTION OF THE DRAWINGS

FIG. 1 is a block diagram of an equivalent circuit according to the first embodiment of this invention.

DESCRIPTION OF THE PREFERRED EMBODIMENTS

Figure 7:
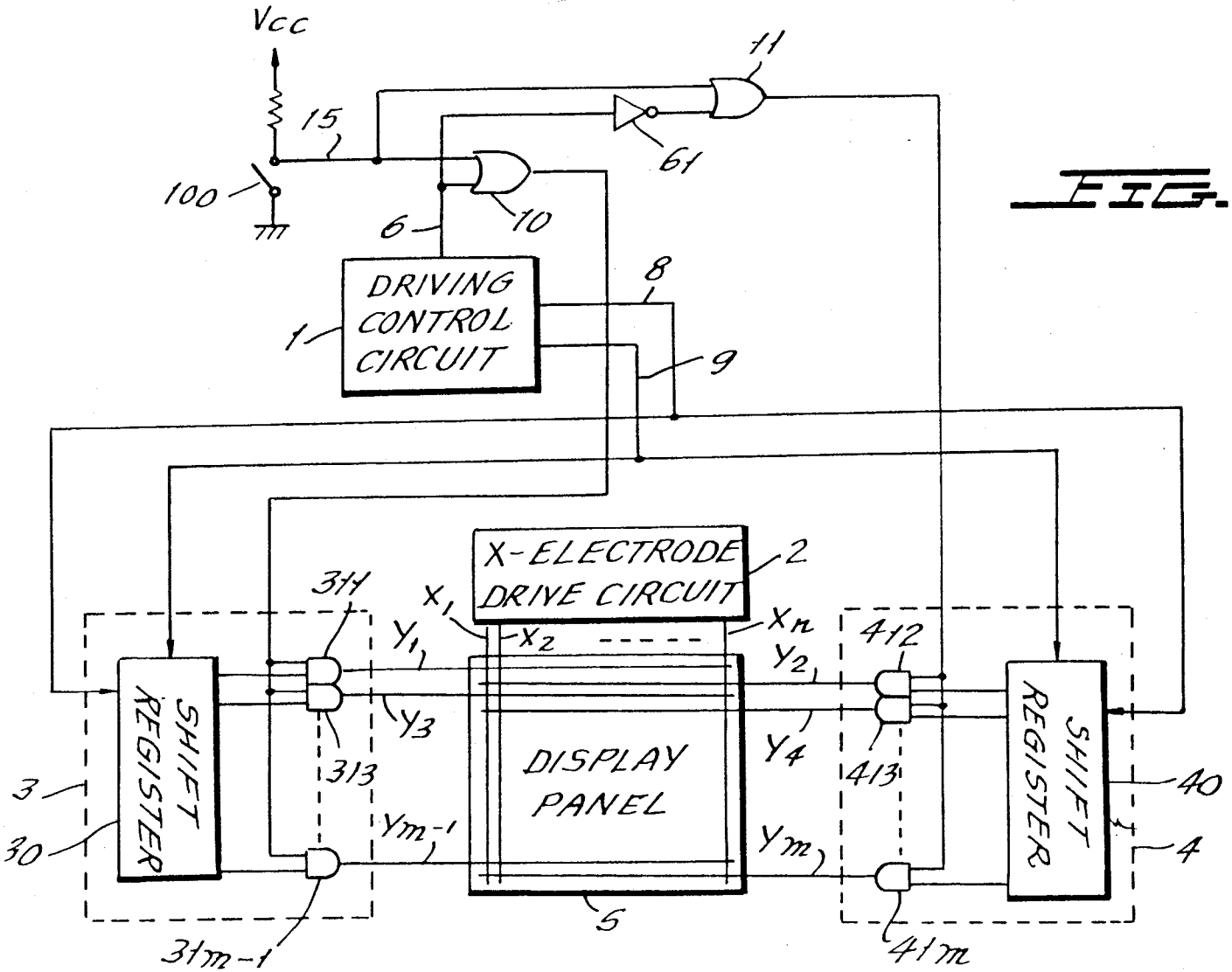
FIGS. 7A–7O and 8A–8O show signal waveforms associated with essential parts of FIG. 5.
Figures 2A, 2B, 2C, 2D, 2E, 2F, 2G, 2H, 2I, 2J, 2K:
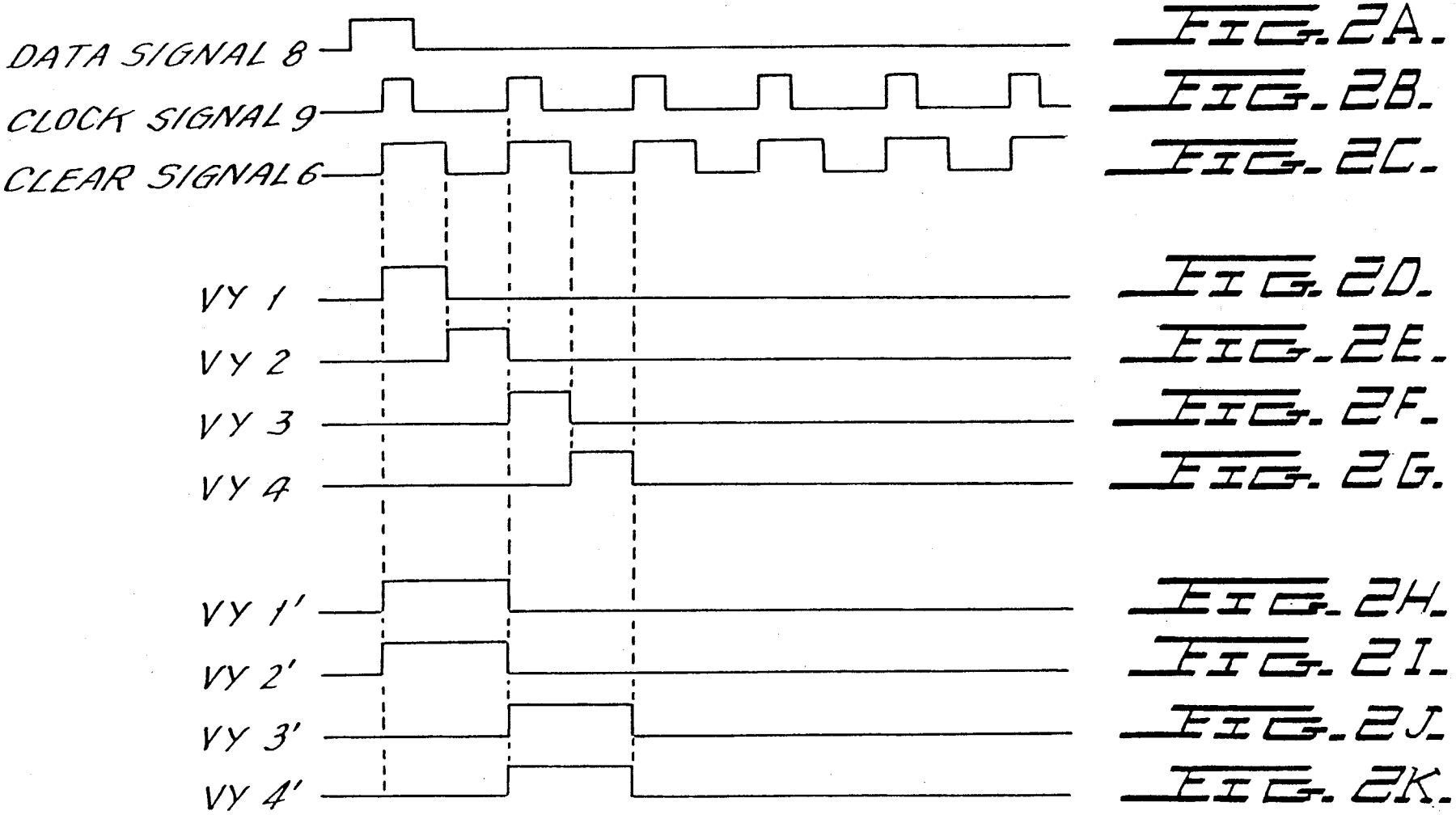
FIGS. 2A–2K show signal waveforms associated with essential parts of FIG. 1.

Referring to FIG. 1, X-electrode group of a display panel 5 is connected to an X-electrode driving circuit 2. Out of the Y-electrode group, the odd-numbered electrodes ($Y_1$, $Y_3$, . . . $Y_{m-1}$) are connected to a Y-odd number electrode driving circuit 3 while the even-numbered electrodes ($Y_2$, $Y_4$, . . . $Y_m$) are connected to a Y-even number electrode driving circuit 4 respectively. The X-electrode driving circuit 2 receives input signals in the same manner as in the prior art. The Y-odd number electrode driving circuit 3 and the Y-even number electrode driving circuit 4 receive as input data signal 8 and clock signal 9 shown in FIG. 2A and FIG. 2B from the driving control circuit 1. Shift registers 30 and 40 inside the Y-odd number electrode driving circuit 3 and the Y-even number electrode driving circuit 4 start a shifting operation on the rising edge of the clock signals 9, and the outputs thereof are connected to the odd number electrodes $Y_1$, $Y_2$, . . . $Y_{m-1}$ and the even-number electrodes $Y_2$, $Y_4$, . . . $Y_m$ via AND gates 311, 313, . . . $\mathbf{31}_{m-1}$ and AND gates 412, 414, . . . $\mathbf{41}_m$, respectively. The output from OR gate 10 for display mode switching is inputted at one of input terminals of the AND gates 311, 313, . . . $\mathbf{31}_{m-1}$ connected to the odd-number electrodes $Y_1$, $Y_3$, . . . $Y_{m-1}$ with output terminals. One of the input terminals of the OR gate 10 receives a clear signal 6 shown in FIG. 2C while the other input terminal receives a display mode switching signals. The display mode switching signals can be obtained by switching a switch 100 connected between a high level signal source $V_{cc}$ and a low level signal source (ground) via a resistance R as shown in FIG. 1 so that either high level signal or low level signal can be inputted arbitrarily to the OR gate 10. The display mode switching signal is simultaneously applied to one of the input terminals of an OR gate 11 for display mode switching. The other input terminal of the OR gate 11 receives the clear signal 6 via an inverter 61. The output from the OR gate 11 is connected to the other input terminal of AND gates 412, 414, . . . $\mathbf{41}_m$ connected to the even-number electrodes $Y_2$, $Y_4$, . . . $Y_m$.

When the switch 100 is in an ON-state, the display mode switching signal becomes low level, and the driving waveforms applied to the scanning electrode group $Y_1$, $Y_2$, . . . $Y_m$ show a conventional single electrode scanning mode as shown in FIG. 2D to FIG. 2G, where the scanning electrodes are sequentially selected one after another.

When the switch 100 is shifted from ON to OFF, as the high level signals are inputted at the OR gates 10 and 11, the control function of the clear signal 6 is cancelled. Therefore, the electrodes $Y_1$ and $Y_2$ are selected at the same time for the first period and after that the electrodes $Y_3$ and $Y_4$ are selected at the same time for the second period as shown in FIG. 2H to FIG. 2K. In other words, in this mode dual electrode scanning which sequentially selects electrodes in units of two electrodes. Accordingly, display modes of two types can be attained by the embodiment by switching the switch 100 between ON and OFF in this way. If three-electrode scanning or four electrode scanning method is additionally provided, it becomes possible to provide display modes or more than three types to one display apparatus.

Figure 3:
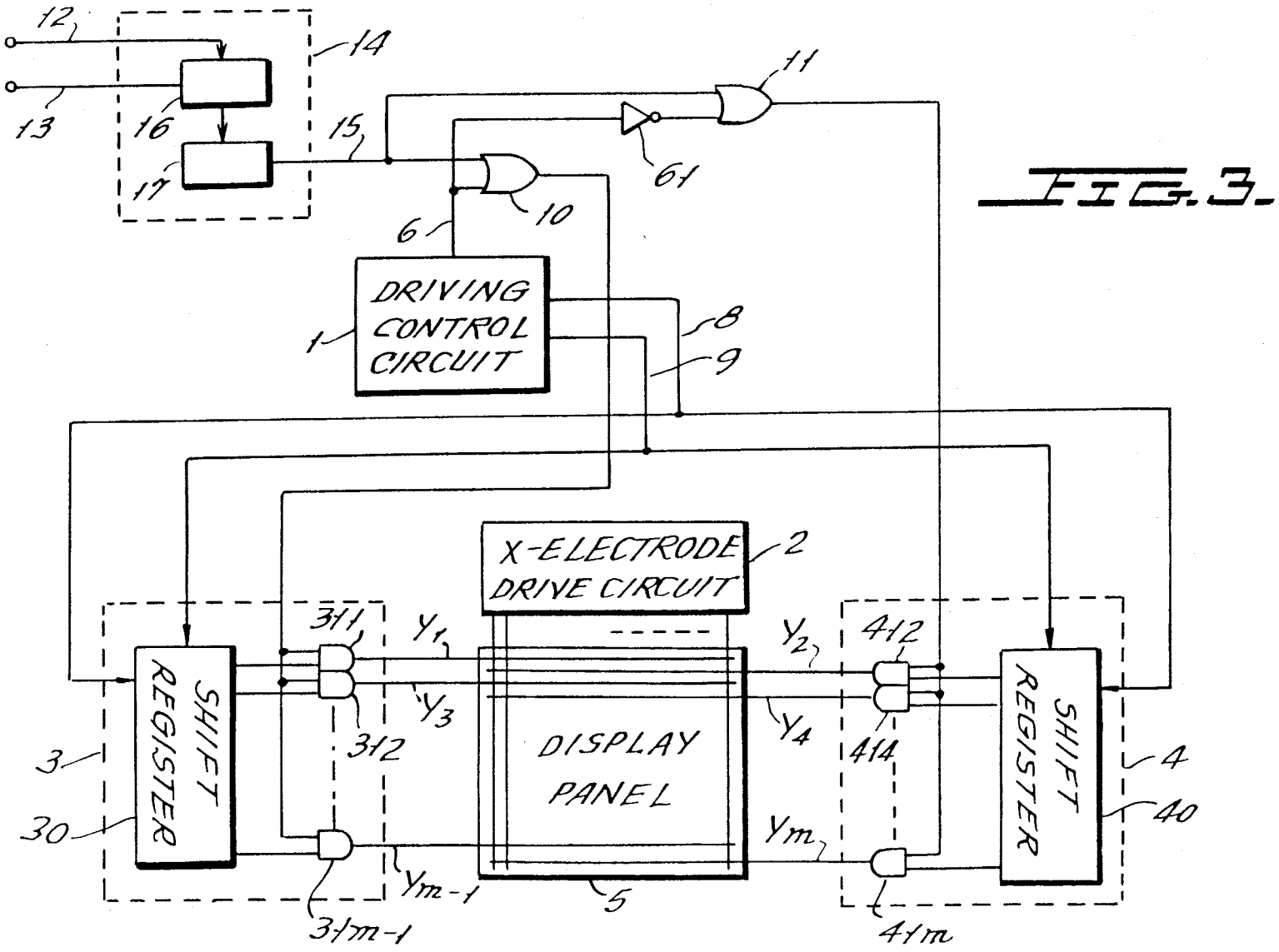
FIG. 3 is a block diagram of an equivalent circuit according to the second embodiment of this invention.

The above embodiment has been discribed in relation to the case where the display mode switching signals are switched manually, but it may be switched automatically in the following manner. FIG. 3 shows another embodiment which is identical to the circuit in FIG. 1 except for an automatic display mode switching circuit 14 which outputs low or high level signals over the display mode switching output 15. The same parts are denoted by the same reference numerals in FIG. 3 and FIG. 1. Vertical synchronizing signal 12 and horizontal synchronizing signal 13 are inputted at the automatic display mode switching circuit 14. The number of horizontal synchronizing pulses included in one period of the vertical synchronizing signal 12 is detected by a counter 16, and the counter output is compared with the number of Y-electrodes by a comparator 17. When the counter output is identical to the Y-electrode number, low level signal is outputted while it is smaller than the Y-electrode number, high level signal is outputted as the display mode switching signal 15. When the low level signal is outputted, the mode becomes single electrode scanning mode while the high level signal is outputted, it becomes dual electrodes scanning mode as described in the foregoing statement referring to FIGS. 1 and 2.

For example, if it is assumed that a display apparatus has 400 Y-electrodes as the scanning electrodes and is equipped with a display panel of the display capacity of 640×400 dots, when the number of horizontal synchronizing signals within one vertical synchronizing signals is 400, the switching signal for the display mode becomes low to perform single electrode scanning and to display of 640×400 dots. When the number of horizontal synchronizing signals within one period of vertical synchronizing signals is 200, the display mode switching signal becomes high to perform dual electrodes scanning mode and display of 640×200 dots. In this manner, the display mode can automatically be switched by using the vertical synchronizing signals and horizontal synchronizing signals as input signals.

Figure 4:
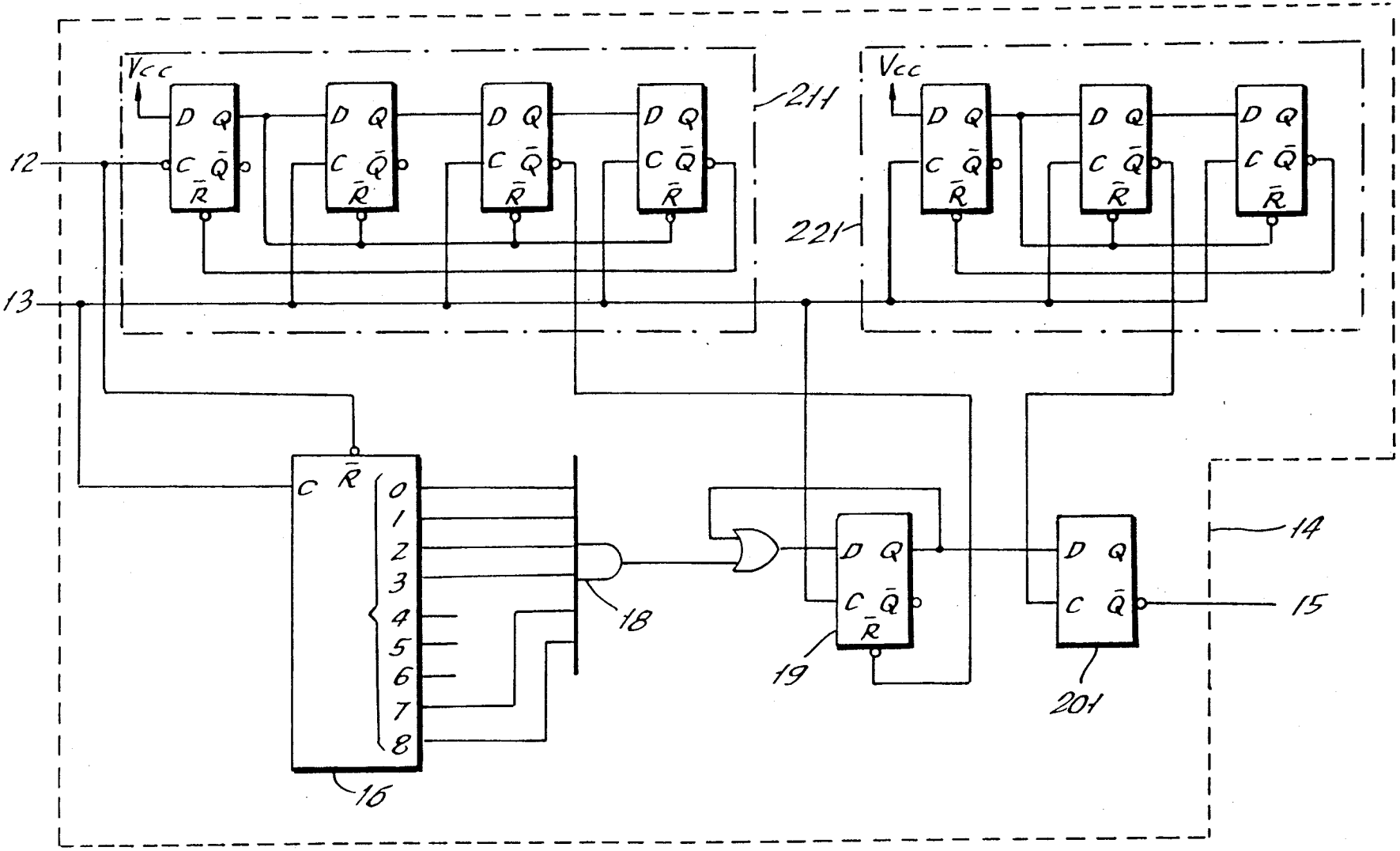
FIG. 4 shows a typical example of an automatic display mode switching circuit 14 in FIG. 3.

A typical example of the automatic display mode switching circuit 14 is shown in FIG. 4. The number of horizontal synchronizing pulses included in one period of the vertical synchronizing signal 12 is counted by a counter 16. The output from the counter 16 are inputted to an AND gate 18, such that when the number of pulses are counted is 399, the output of the AND gate 18 becomes high. Receiving the high level signal from the AND gate 18, the first delay flip-flop 19 outputs a high signal at terminal Q by receiving the 400th pulse of the horizontal synchronizing signal 13. Then the second delay flip-flop 201 which is connected to the first delay flop-flop 19 is used to output and hold a low signal as the display mode switching signal 15 at terminal Q during next one period of the vertical synchronizing signal 12. Accordingly, when the number of pulses of the horizontal synchronizing signal 13 included in one period of the vertical synchronizing signal 12 is 400 or more, a high display switching signal 15 is obtained for single electrode scanning mode. Needless to say, when the counted pulses are less than 400, the output from the terminal Q of the second flip-flop 201 becomes high for dual electrodes scanning mode. A group of four flip-flops 211 comprise a reset signal generating circuit for resetting the flip-flop 19 and a group of three flip-flops 221 comprise a clock signal generating circuit for the flip-flop 201.

Figure 5:
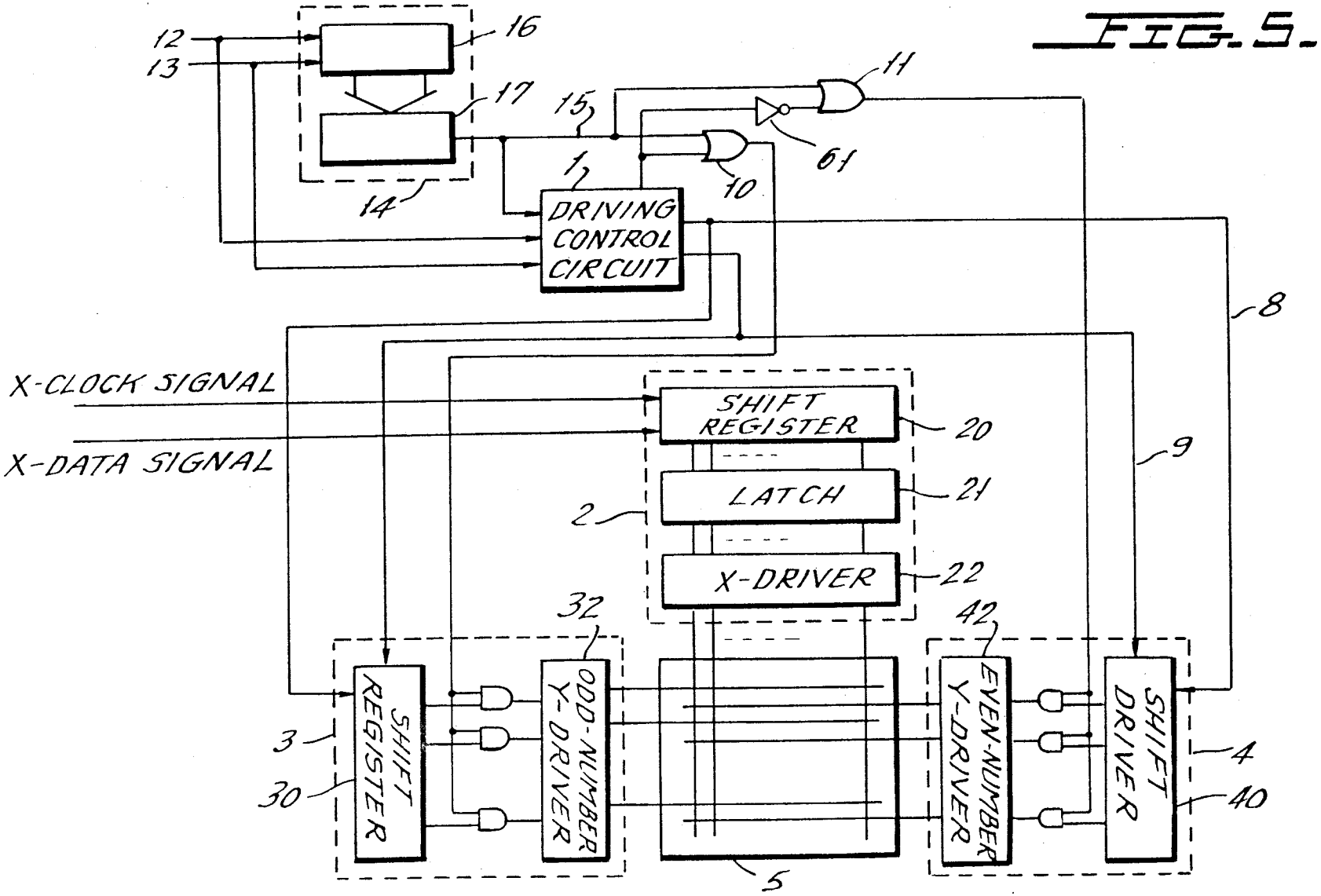
FIG. 5 is a block diagram of an equivalent circuit according to the third embodiment of this invention.

Referring to FIG. 5, the third embodiment of the present invention has a feature that a driving control circuit 1 is designed to change the period of a clock signal between a single electrode scanning mode and a dual electrodes scanning mode. To this end, a vertical synchronizing signal 12 and a horizontal synchronizing signal 13 are inputted to the control circuit 1. Furthermore, the display mode switching signal 15 is also inputted to the control circuit 1.

Figure 6:
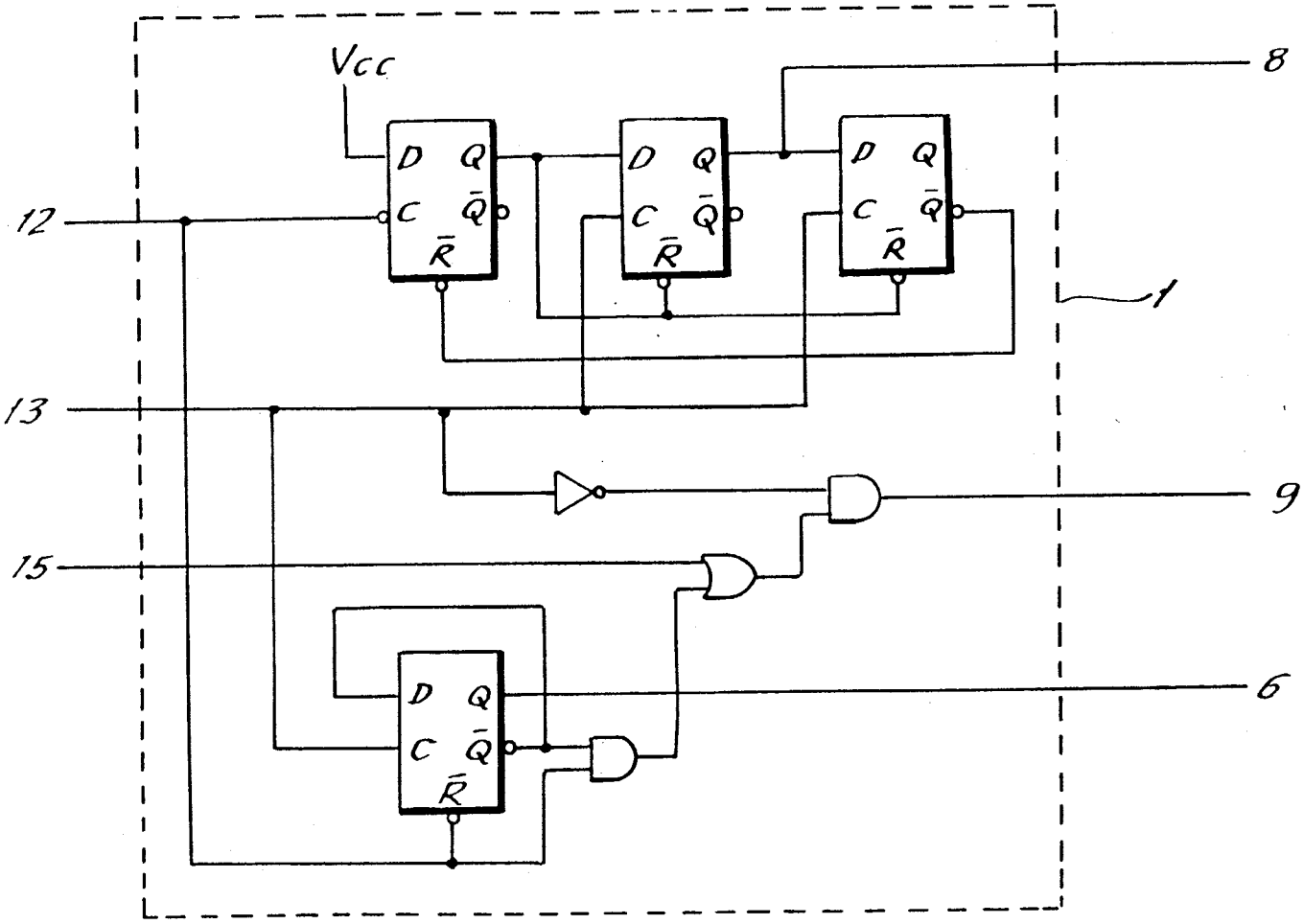
FIG. 6 shows a typical example of a drive control circuit 1 in FIG. 5.
Figures 7A, 7B, 7C, 7D, 7E, 7F, 7G, 7H, 7I, 7J, 7K, 7L, 7M, 7N, 7O:
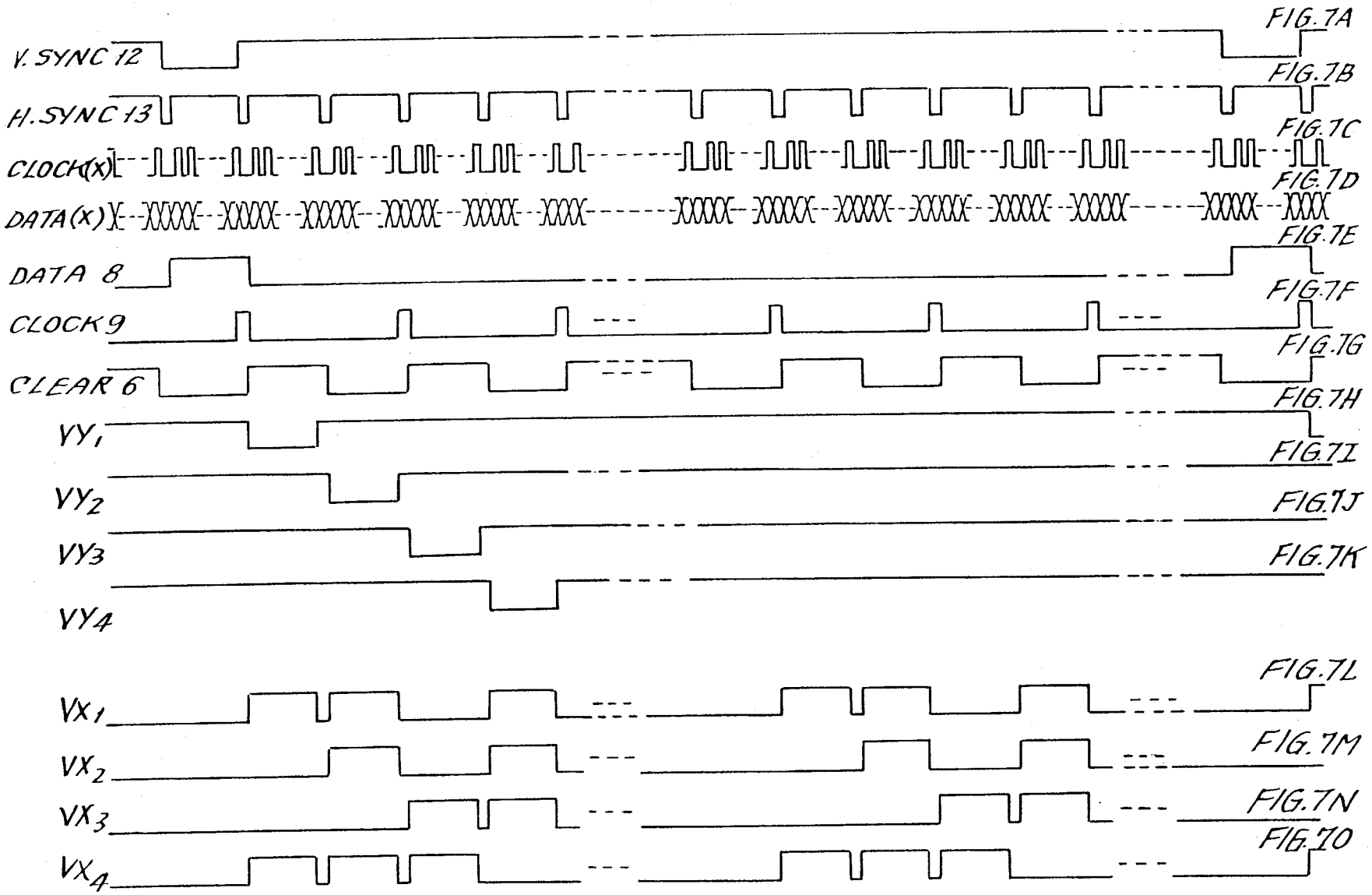
Figures 8A, 8B, 8C, 8D, 8E, 8F, 8G, 8H, 8I, 8J, 8K, 8L, 8M, 8N, 8O:
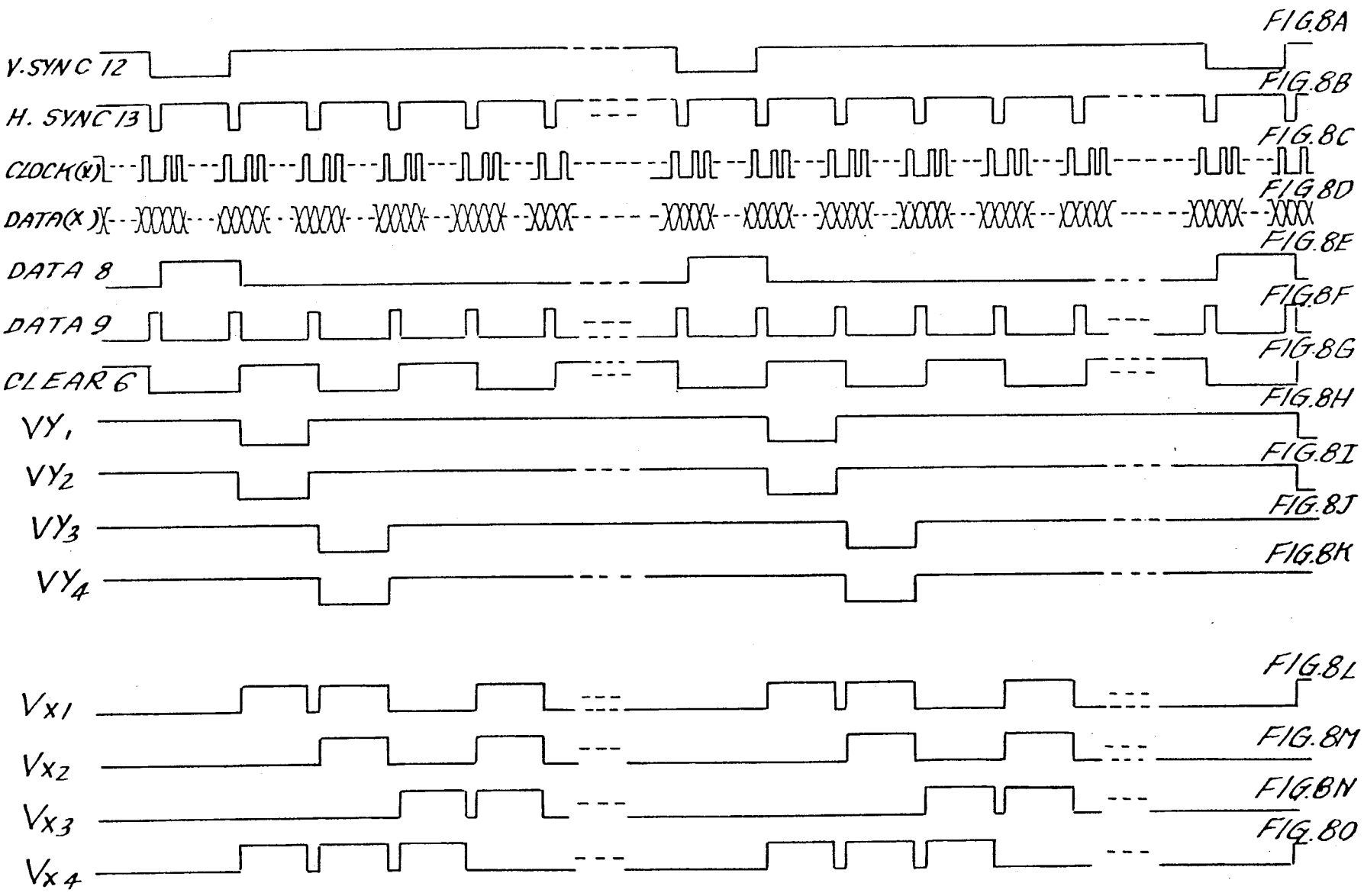

A typical example of the control circuit 1 is shown in FIG. 6. Assuming that the horizontal synchronized signal 13 is constant and the vertical synchronizing signal 12 is different for the different scanning modes, as shown in FIG. 7A and FIG. 8A, the data signal 8 and the clock signal 9 are changed as shown in FIG. 7E, FIG. 8E, FIG. 7F and FIG. 8F. The clear signal 6 is not changed as shown in FIG. 7G and FIG. 8G. According to this embodiment, a single electrode scanning mode is obtained as shown in FIG. 7H to FIG. 7K in the same manner as described in the foregoing embodiments. FIGS. 7L and 7O show typical example of switching signals to be applied to X-electrode driver 22. The clock signal and data signal for X-electrodes, which are shown in FIG. 7C and FIG. 7D, are applied to a shift register 20 in an X-electrode driving circuit 2 in a well known manner to obtain the switching signals through the latch circuit 21 as shown in FIG. 5. Drivers 22, 32 and 42 produce appropriate drive voltages that are applied to display electrodes depending on the panels, such as AC low voltage for a liquid crystal display panel, DC high voltage for an internal electrode type gas discharge panel and a rapidly toggling voltage for an external electrode type plasma display panel, all in well known manner.

On the other hand, a dual electrode scanning mode is obtained as shown in FIG. 8H to FIG. 8K. The obtained scanning signals are different from the first embodiment in which wherein the clock signal 9 remains unchanged. In the present embodiment, however, the clock signal 9 is changed such that the period of each scanning signal is shortened to half the period of the signals shown in FIG. 2H to FIG. 2K. In FIG. 8, switching signals to be applied to X-electrodes and clock and data signals applied to X-electrode driven circuit 2 is not changed as shown in FIG. 8L to FIG. 8O, FIG. 8C and FIG. 8D.

What is claimed is:

1. A display apparatus, comprising: a display panel having display cells and a first group of electrodes and a second group of electrodes effective for activating therewith desired ones of said display cells, a first driving circuit connected to said first group of electrodes for selectively applying driving signals to electrodes thereof, a second driving circuit connected to said second group of electrodes for selectively applying driving signals to electrodes of said second group in correspondence with the signal applying timing of said first driving circuit, a first control means for controlling said first driving circuit such that each of said first group of electrodes is sequentially selected one after another in a time-division multiplexed mode, a second control means for controlling said first driving circuit such that a plurality of adjacent electrodes of said first group of electrodes are simultaneously selected and different pluralities of adjacent electrodes are selected in a time-division multiplexed mode, and, a third control means for actuating one or the other of said first control means and said second control means.

2. The display apparatus as claimed in claim 1, wherein said first driving circuit includes an odd-number electrode driving circuit connected only to odd-numbered electrodes of said first group of electrodes and an even-number electrode driving circuit connected only to even-numbered electrodes of said first group of electrodes, said first control means being effective for sequentially and alternately supplying an output from said odd-number electrode driving circuit and from said even-number electrode driving circuit such as to select one electrode at a time, and said second control means being effective for sequentially supplying the outputs from said odd-number electrode driving circuit and from said even-number electrode driving circuit such as to simultaneously select a pair of electrodes.

3. The display apparatus as claimed in claim 1, said third control means including a counter which counts the number of horizontal synchronizing signals existing within one period of the vertical synchronizing signals and a comparator which is connected to the output of said counter to compare the number of said horizontal synchronizing signals with the number of said first group of electrodes, the output from said comparator driving said first control means but not said second control means when the number of said horizontal synchronizing signal coincides with the number of said first group of electrodes, and driving said second control means but not said first control means when the number of said horizontal synchronizing signals is smaller than the number of said first group of electrodes.

4. A display apparatus, comprising:

a display panel having a group of scanning electrodes and a group of data electrodes disposed in a matrix relative to each other to allow the electrodes to address display cells, an odd-number electrode scanning circuit for applying time-division multiplexed scanning signals to odd-numbered electrodes of said group of scanning electrodes, an even-number electrode scanning circuit for applying time-division multiplexed scanning signals to even-numbered electrodes of said group of scanning electrodes, a data electrode driving circuit for applying driving signals to selected electrodes of said group of data electrodes in synchronism with said time-division multiplexed signals, a first control means for driving said odd-number electrode scanning circuit and said even-number electrode scanning circuit alternately in accordance with a staggered, mutually exclusive, timing sequence, a second control means for driving said odd-number electrode scanning circuit and said even-number electrode scanning circuit simultaneously, and, a third control means for selecting either one of said first and the second control means for being activated.

5. A display apparatus, comprising:

a plurality of data electrodes;

a plurality of scanning electrodes, said electrodes being such that simultaneous activation of at least one each of the data and scanning electrodes is effective to select a desired one of a plurality of display cells associated with said display apparatus;

a first electrode driving circuit coupled to and effective for driving said data electrodes;

a second electrode driving circuit coupled to and effective for driving a first group of said scanning electrodes;

a third electrode driving circuit coupled to and effective for driving a second group of said scanning electrodes; and control means coupled to said second and third electrode driving circuits and effective for controlling said second and third electrode driving circuit such that said display apparatus is operable in accordance with either a first mode wherein each of said scanning electrodes is activated on a mutually exclusive basis and in accordance with a second mode wherein electrodes associated with said first and second groups are activated synchronously with one another.

6. The display apparatus of claim 5, wherein each of said second and third driving circuits comprises a shift register and said driving control circuit is responsive to vertical and horizontal synchronization signals.

7. The display apparatus of claim 6, wherein said control circuit comprises a counter which is reset by vertical synchronization signal and which is effective for counting a predetermined number of pulses of said horizontal synchronization signals.

8. The display apparatus of claim 7, wherein said control circuit comprises a manual switch for selecting between said first and second modes.

9. The display apparatus of claim 7, wherein said control circuit comprises an automatic circuit for selecting between said first and second modes.

* * * * *